United States Patent [19]

Salomon et al.

[11] Patent Number: 4,496,169

[45] Date of Patent: Jan. 29, 1985

[54] STEP-IN SKI BINDING

[75] Inventors: Georges P. J. Salomon, Annecy; Jacques Quellais, Saint-Jorioz, both of France

[73] Assignee: Salomon S.A., Annecy, France

[21] Appl. No.: 337,824

[22] Filed: Jan. 7, 1982

[30] Foreign Application Priority Data

Jan. 13, 1981 [FR] France ..... 81 00836

[51] Int. Cl.[3] ..... A63C 9/10

[52] U.S. Cl. ..... 280/615; 280/632

[58] Field of Search ..... 280/614, 615, 631, 632; 292/78, 79, 216; 36/117

[56] References Cited

U.S. PATENT DOCUMENTS 4,302,028 11/1981 Svoboda ..... 280/631

FOREIGN PATENT DOCUMENTS 222828 5/1909 Fed. Rep. of Germany .
569828 1/1933 Fed. Rep. of Germany ..... 280/615
2715907 4/1977 Fed. Rep. of Germany .
3002874 8/1980 Fed. Rep. of Germany ..... 280/615
2439602 10/1978 France .
322456 11/1934 Italy ..... 280/615

*Primary Examiner*—David M. Mitchell
*Assistant Examiner*—Joseph G. McCarthy
*Attorney, Agent, or Firm*—Sandler & Greenblum

[57] ABSTRACT

A step-in binding for securing a ski shoe or boot having a latching element including a transverse bit across and in front of the shoe or boot onto a ski. The binding includes a support element to be mounted on a ski, and a movable latch to be secured to the ski. The latch includes a movable pressure element and means for biasing the movable pressure element towards the support element. The shoe or boot may be secured by the binding to the ski by inserting the transverse bit between the support element and the pressure element when the movable pressure element is biased towards the support element and lowering the transverse bit between the movable pressure element and the support element.

21 Claims, 12 Drawing Figures

STEP-IN SKI BINDING

BACKGROUND OF THE INVENTION

1. Cross-Reference to Related Applications

Reference is made to U.S. Pat. No. 4,382,611, entitled SKI BINDING AND BOOT, the disclosure of which is hereby incorporated by reference.

2. Field of the Invention

The present application relates to a ski binding for securing a ski boot to a ski.

According to the present application a binding is provided in which the shoe is inserted automatically; what is commonly known as a "step-in" binding.

Although the apparatus of the invention can be used to secure either the front and/or the rear of the boot when practicing downhill skiing, it is more particularly adapted, in the context of the present invention, as a binding finding particular use to secure the front end of the ski shoe or boot, with the heel being free to lift off the ski, as occurs in mountaineering or cross-country-type skiing.

SUMMARY OF THE INVENTION

In a broad sense, the invention is directed to a step-in binding for securing a ski shoe or boot comprising a latching element having a transverse bit across and in front of the shoe or boot onto a ski. The binding includes a support element adapted to be mounted on a ski; and a movable latch adapted to be secured to the ski. The latch comprises a movable pressure element. Means are provided for biasing the movable pressure element towards the support element. The shoe or boot is secured by the binding to the ski by inserting the transverse bit between the support element and the pressure element when the movable pressure element is biased towards the support element and lowering the transverse bit between the movable pressure element and the support element.

The step-in binding may further comprise the latching element of the shoe or boot, the latching element comprising two lateral arms, with the transverse bit extending between the two lateral arms.

The movable pressure element of the step-in binding may further comprise a pressure nose adapted to be biased against the support element when the binding is in the locked position.

Additionally, the movable pressure element of the step-in binding may comprise an incline adapted to exert pressure on the transverse bit in a direction along the support element whereby the shoe or boot is pulled towards the support element such that a support zone on the front of the shoe or boot is pressed against an abutment zone on the support element when the shoe or boot is secured by the binding.

The movable pressure element of the step-in binding may also comprise a pressure surface adapted to be pressed against a pressure zone on the support element prior to insertion of the transverse bit into the binding when the binding is in the locked position.

A "V"-shaped insertion opening may be formed between the support element and the movable element prior to insertion of the bit when the binding is in the locked position.

The "V"-shaped insertion opening of the step-in binding can be formed by an incline on the support element and an inclined surface on the movable pressure element.

The binding may further comprise a shoulder adapted to be mounted on the ski, the shoulder being adapted to provide a pivot point and to limit the movement of the base of the movable pressure element when the binding is in the locked position. The shoulder may be integral with or distinct from the support element.

The movable pressure element comprises a lower transverse portion adapted to be held by the shoulder. The shoulder comprises a vertical portion and a curved portion, the vertical portion and the curved portion providing a space sufficient to accommodate the lower transverse portion of said movable pressure element.

Alternatively, the binding may comprise an arch adapted to be mounted on the ski with the movable pressure element comprising a lower transverse portion extending through the arch. The arch has a vertical dimension greater than the lower transverse portion so as to allow for the vertical displacement of the lower transverse portion in the arch.

The movable pressure element is journalled on a mounting, and contains elastic means adapted to permit the translational movement of the movable pressure element relative to the mounting when the transverse bit is inserted in the arch.

The means for biasing the movable pressure element is constituted by the mounting referred to above having a transverse mounting bit extending through an oblong slot in the movable pressure element; and pivot means adapted to be mounted on the ski. The movable pressure element is held by the mounting whereby the movable pressure element is pivotable around the pivot means. Elastic means serve to resist pivotable movement of the movable pressure element away from the support element. The elastic means may be in the form of a compressible resilient plug positioned within the oblong slot.

BRIEF DESCRIPTION OF THE DRAWINGS

The invention will be better understood with reference to the annexed drawings which illustrate the invention by way of example only, in which:

FIG. 1 is a side elevational view of the apparatus with the boot secured;

FIG. 2 is a top planar view of the apparatus of FIG. 1;

FIG. 3 is a longitudinal cross sectional view along line III—III of FIG. 2;

FIG. 4 is a perspective view of the binding and boot in the inserted position;

FIG. 5 is a perspective view before insertion of the boot;

FIG. 6 is a partial rear perspective view of the support element and of the movable element;

FIG. 7 is a lateral view at the beginning of insertion of the boot;

FIGS. 8 and 9 are lateral views in partial cross section during insertion;

DESCRIPTION OF PREFERRED EMBODIMENTS

Figure 1:
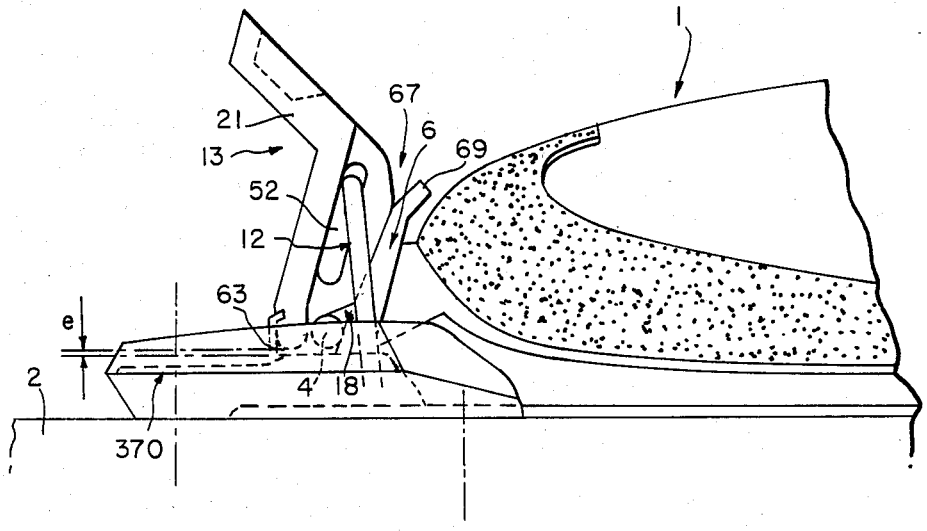
FIGS. 1–9 illustrate one embodiment of the invention.
Figure 2:
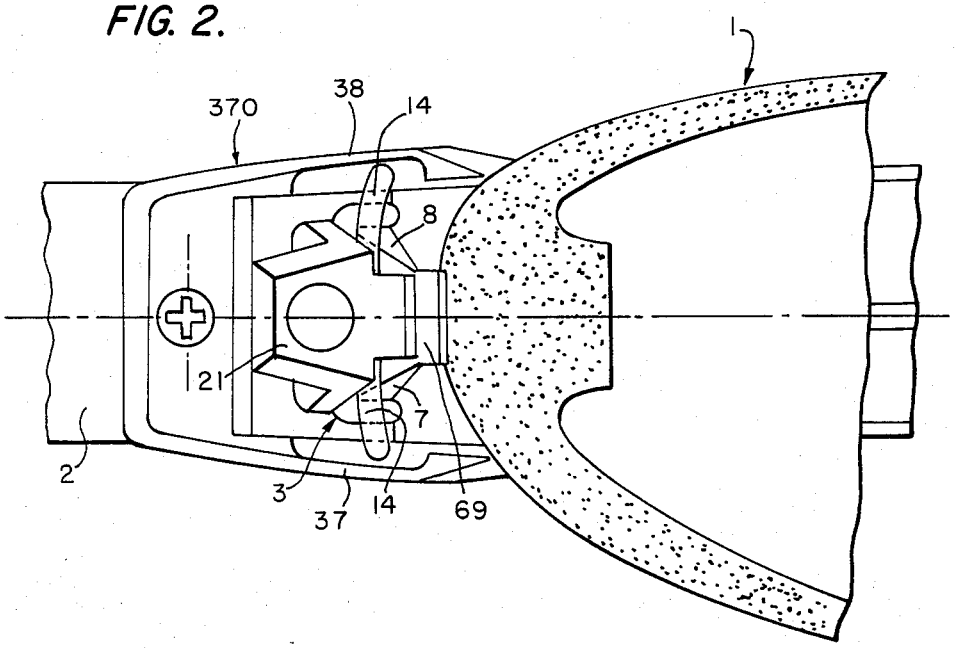
Figure 3:
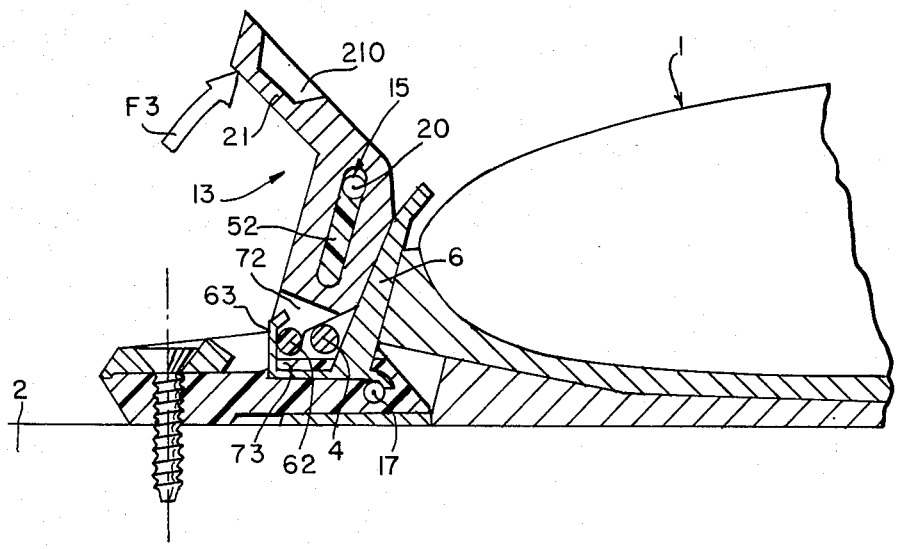
Figure 5:
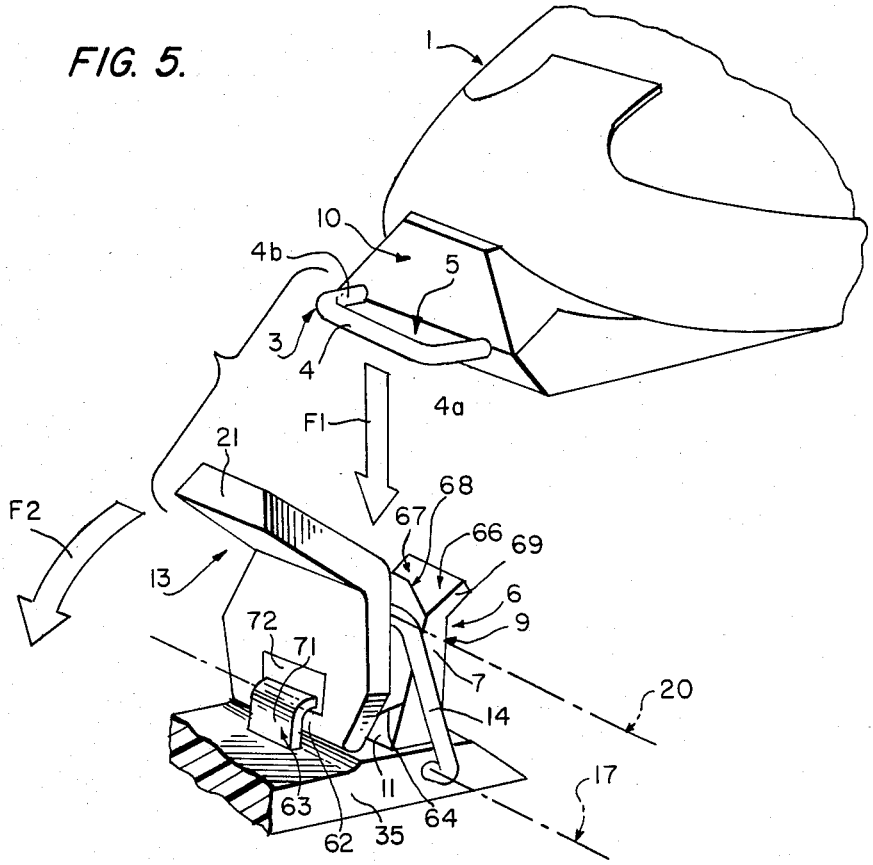
Figure 6:
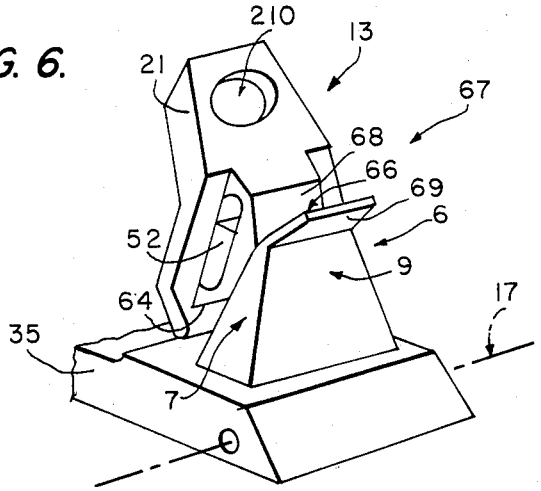
Figure 7:
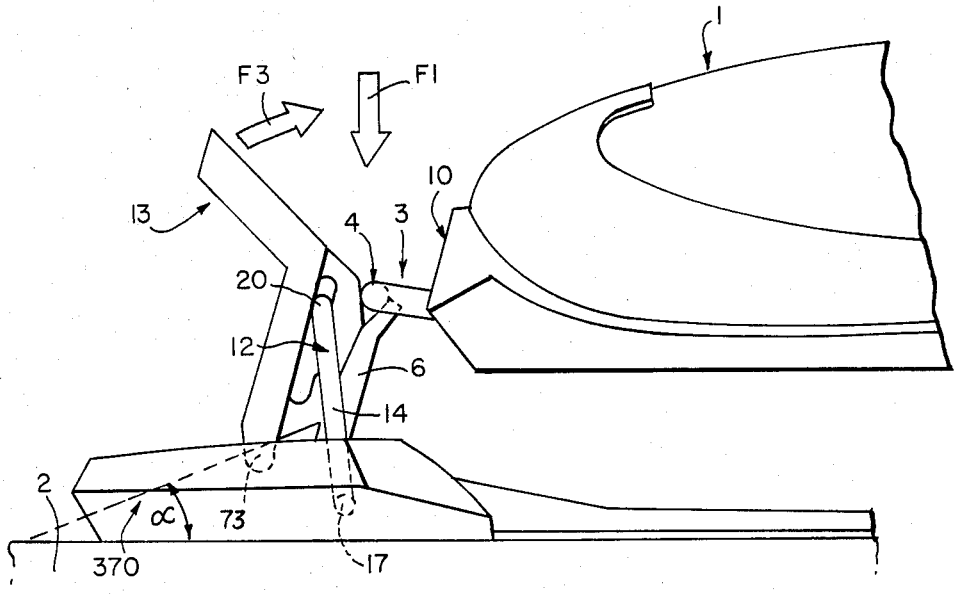
Figure 8:
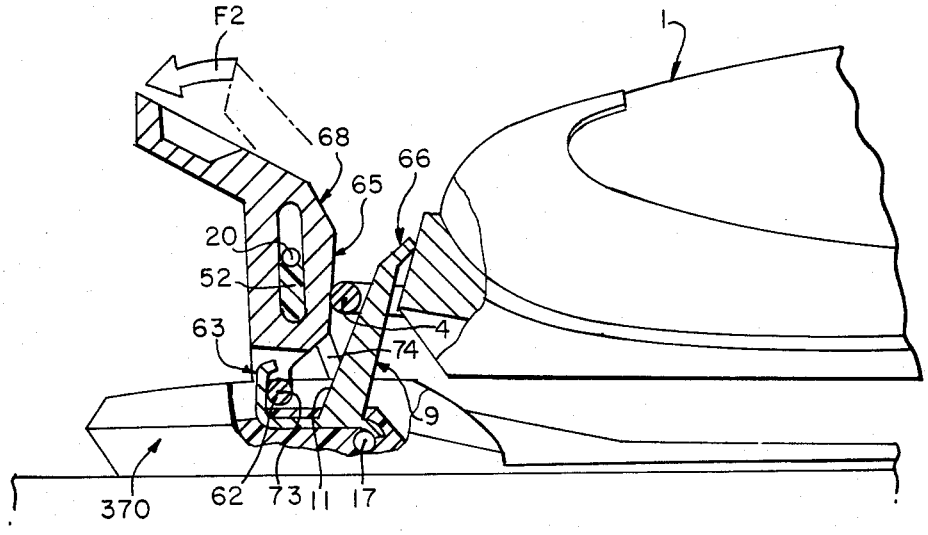
Figure 9:
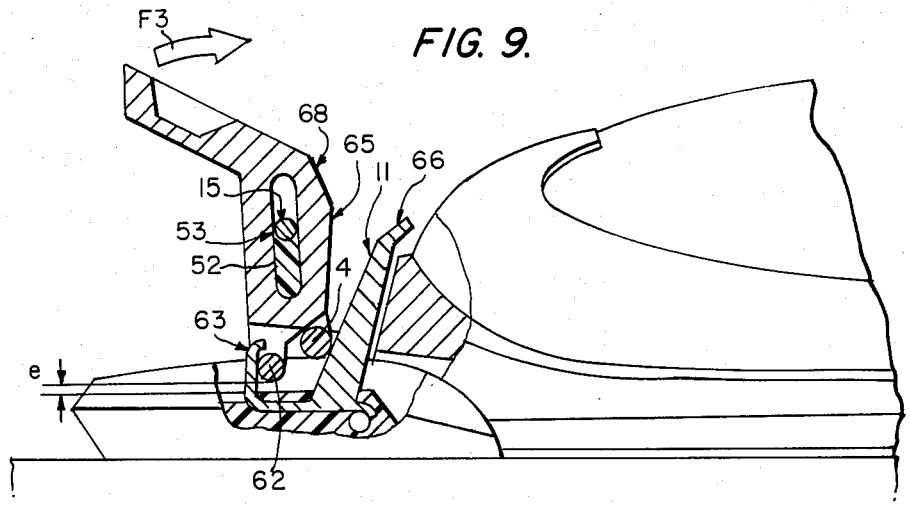

As seen in FIG. 5, boot 1 comprises a latching element 3 extending from the front of the boot. The latching element 3 is preferably formed of a ring made of a cylindrical steel wire and comprises a transverse bit 4 and two lateral arms 4*a* and 4*b* whose ends are secured by being embedded in the shoe which is molded around them. Transverse bit 4 is spaced from the front of the boot and extends therefrom to provide an opening 5 which is adapted to receive a support element 6 during insertion of the boot which occurs through vertical displacement of the boot along the direction $F_1$ (FIG. 7). Support element 6 is preferably a contoured element which projects outwardly and extends transversely above the surface of the ski 2. As noted in application Ser. No. 116,847, the support element can be either connected to the ski in a fashion so as to be immobile with respect thereto (as in FIGS. 23 and 24 of the application), or connected to the ski in a movable fashion. In the latter case, support element 6 can be either positioned in a pivotable fashion with respect to the ski (as shown in FIGS. 29 and 30 of the application), or positioned on a flexion blade connected to the ski by its front end as is the case in FIGS. 25–28 and 31 and 32 of the application. Support element 6 has the general shape of an inverted V-shaped projection and protrudes in the inserted position in opening 5 between transverse bit 4 and the front 2 of the boot 1. The support element extends transversely between lateral arms 4*a* and 4*b* of the latching element 3 (FIG. 2) which thus assures the lateral retention of the boot by cooperation of the arms with the lateral surfaces 7 and 8 (FIG. 2).

Furthermore, the support element comprises an abutment zone 9 cooperating with the corresponding support zone 10 on the front of the shoe or boot. The support element also comprises a pressure zone incline 11 adapted to cooperate with the transverse bit 4 of the latching element. The two zones 9 and 11 are preferably planes forming a dihedral between them. The front support zone 10 of the boot is maintained in contact with the shoulder zone 9 of the support element 6 by virtue of a retention system comprising a movable pressure element 13 journalled on a mounting 12. The mounting is preferably constituted by a stirrup made out of cylindrical steel wire having a generally U-shape which comprises two lateral arms 14 connected by a transverse mounting bit 15 on which the movable pressure element 13 is pivotably mounted. Lateral arms 14 have their free ends 16 bent and engaged in a pivotable fashion in openings having geometrical axis 17. The movable pressure element 13 comprises a pressure nose 18 adapted to cooperate with the transverse bit 4 of the latching element 3 so as to bias the support zone 10 of the boot against the abutment zone 9 of the support element. The movable pressure element has at its upper portion an extension which acts as a release lever 21.

Furthermore, between the lever and the pressure nose, the movable pressure element 13 comprises a slot 53 comprising on the one hand an elastic system 52 and, on the other hand, the transverse bit 15 of the mounting. Elastic system 52 is preferably mounted as a plug in the movable pressure element and is made out of a deformable resilient elastic material such as polyurethane.

According to one aspect of the invention, the lower portion 62 of the movable pressure element 13 comprises a lower transverse portion and rests against a shoulder 63 connected to support element 6.

In the embodiment shown in FIGS. 1–10, shoulder 63 is integral with the support element 6, the assembly being embedded in flexion blade 35. It is quite obvious, however, that one can use a different arrangement, for example, shoulder 63 could be independent of support element 6.

It is also seen that shoulder 63 comprises a vertical projecting portion 70 ending in a curved portion 71. The lower portion of the movable pressure element, in the form of a lower transverse bit, rests against shoulder 63. The lower portion of the movable pressure element is provided at its median portion with a void 72 defining the transverse support arm or bit 73.

The vertical portion 70 is such that it allows for a vertical displacement of support arm 73.

Figure 4:
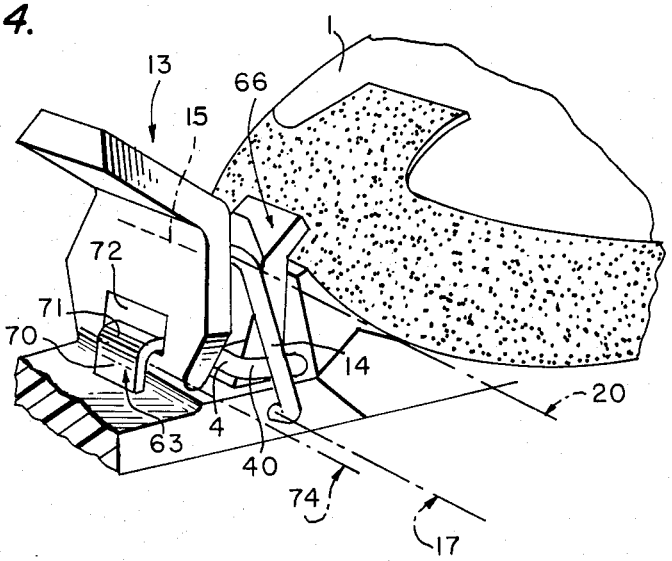

Support arm 73 is preferably cylindrical in shape and thus defines a support axis 74 (FIG. 4). At its rear portion, i.e., directed towards the support element, the pressure nose 18 comprises an incline 64 adapted to rest, when in the locked position, against the transverse bit 4 of the latching element. Incline 64 is preferably a plane which is inclined with respect to the ski, forming an angle $\alpha$ with the ski (FIG. 7), open towards the rear. It should furthermore be noted that incline 64 merges upwardly with a face 65 resting against zone 11 of support element 6 by virtue of the force exerted by elastic system 52. Furthermore, movable pressure element 13 comprises an insertion incline 68 which is preferably a plane inclined in a fashion so as to form an acute angle open rearwardly with respect to the ski.

Figure 10:
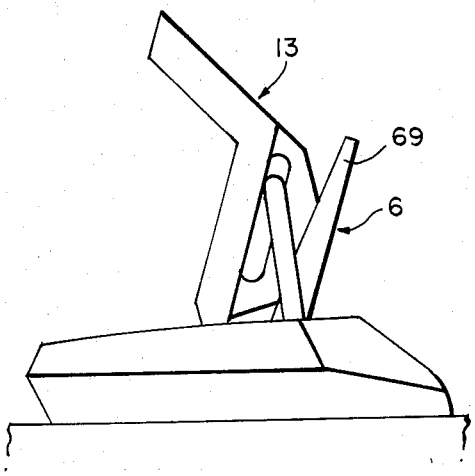
FIG. 10 is an alternative embodiment of the support element.

Support element 6 further preferably comprises an extension 69 which is inclined towards the rear (according to FIGS. 1–8) and comprises an insertion incline 66 defining with the ramp 68 of the movable pressure element an insertion "V" 67 which is open upwardly and adapted to receive the transverse bit of latching element 3 of the boot. FIG. 10 illustrates that extension 69 need not necessarily be rearwardly inclined, but only be an extension of the support element 6.

Without the boot, movable pressure element 13 and its mounting 12 constitute a kneecap elastic system. In effect, support axis 74 is located forwardly of the plane defined by the axes 17 and 20 and the elastic system thus has a tendency to bias the movable pressure element along direction $F_3$, i.e., towards the support element, the surface 65 thus being elastically biased to rest against the support element.

The insertion of the boot is performed vertically by first positioning the transverse bit 4 in the insertion "V" 67 (FIG. 7), then lowering the boot forwardly along the direction of $F_1$ (FIG. 7) to introduce the support element 6 into the open space 5 in the front of the boot by causing frontward pivoting in the direction $F_2$ (FIG. 8) of the movable pressure element 13. During this movement, it is noted that bit 4 slides downwardly between surface 65 and zone 11. On the other hand, pivoting of element 13 occurs against shoulder 63. Pivoting thus occurs around axis 73 against the action of elastic system 52. In effect, there is a reduction of the distance between the axes 20 and 17 on the one hand, and the axes 17 and 74 on the other hand, thus causing the compression of the elastic system 52. When transverse bit 4 reaches latching incline 64, movable element 13 springs back towards the rear along direction $F_3$ (FIG. 9) until it rests against the support element as shown in FIGS. 1–4. In the latched position, it will be noted that the movable pressure element is slightly displaced upwardly ultimately permitting a slight clearance "e". This upward displacement results in the slight compression of elastic system 52. Movable pressure element 13 exerts a force on the bit which has a vertical component directed downwardly which assures the pressing of support zone 10 of the boot against abutment zone 9 of support element 6.

As was seen above, insertion occurs automatically and release occurs by manually pivoting the movable pressure element along the direction $F_2$. To do this, a hollow 210 provided in the lever 21 is adapted to receive the point or tip of a ski pole. By pressing with the pole, one need only raise the front of the foot to disengage the boot from the binding.

Figure 11:
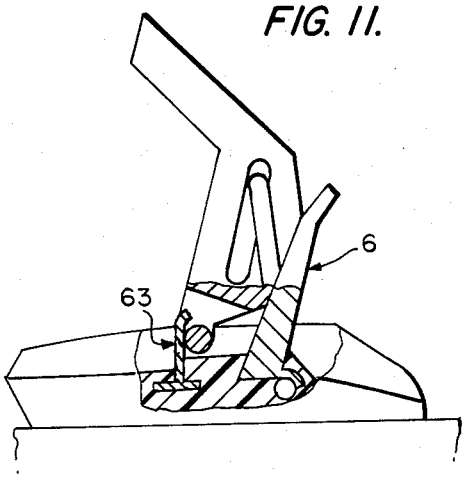
FIGS. 11 and 12 illustrate alternative embodiments of the shoulder.

As can be seen in FIG 11, it is evident that shoulder 63 need not necessarily be made an integral portion of support element 6, but can also be an independent element.

Figure 12:
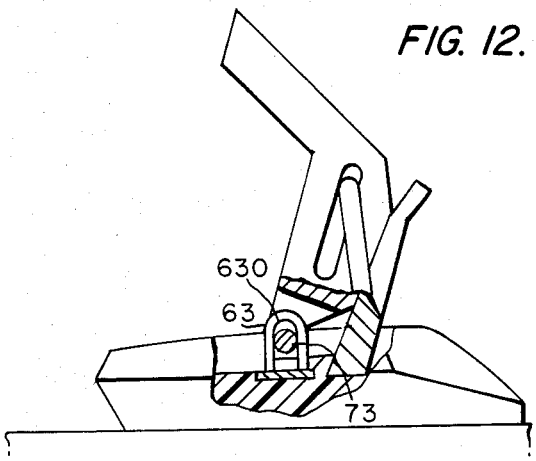

FIG. 12 illustrates an alternative embodiment of shoulder 63 in the form of an arch 630 surrounding support arm 73. Arch 630 extends upwardly to allow for the vertical displacement of support arm 73.

In the embodiments described, the support element and shoulder are mounted on a flexion blade 35 but this need not necessarily be the case as is described in the previously referenced application. In effect, support element 6 and the shoulder 63 can also be either integral with the ski as is shown in FIGS. 1–24 of the application or integral with a pivotable element, as is shown in FIGS. 29 and 30 of the application.

Although the invention has been described with respect to particular means, embodiments and materials, it is understood that the invention is not limited to the particulars disclosed and extends to all equivalents within the scope of the claims.

What is claimed is:

1. Step-in binding for securing a ski shoe or boot onto a ski, wherein said boot comprises a latching element having a transverse bit across and in front of said shoe or boot, said binding comprising:

(a) a support element adapted to be mounted on a ski;

(b) a movable latch adapted to be secured to said ski, said latch comprising a movable pressure element;

(c) means for biasing said movable pressure element towards said support element when said boot is unsecured to said binding, wherein said biasing means comprises:

a mounting comprising a transverse mounting bit extending through a slot in said movable pressure element;

pivot means adapted to be mounted on said ski, said movable pressure element being held by said mounting whereby said movable pressure element is pivotable around said pivot means; and elastic means adapted to resist pivotable movement of said movable pressure element away from said support element, whereby said shoe or boot may be secured by said binding to said ski by inserting said transverse bit between said support element and said pressure element when said movable pressure element is biased toward said support element and lowering said transverse bit between said movable pressure element and said support element.

2. The step-in binding as defined by claim 1 further comprising said latching element of said shoe or boot, said latching element comprising two lateral arms with said transverse bit extending between said two lateral arms.

3. The step-in binding as defined by claim 1 wherein said movable pressure element further comprises a pressure nose adapted to be biased against said support element when said binding is in the locked position.

4. The step-in binding as defined by claim 3 wherein said movable pressure element further comprises an incline adapted to exert pressure on said transverse bit in a direction along said support element whereby said shoe or boot is pulled towards said support element such that a support zone on the front of said shoe or boot is pressed against an abutment zone of said support element when said shoe or boot is secured by said binding.

5. The step-in binding as defined by claim 1 wherein said movable pressure element comprises a pressure surface adapted to be pressed against a pressure zone on said support element prior to insertion of said transverse bit into said binding when said binding is in the locked position.

6. The step-in binding as defined by claim 1 wherein said support element and said movable element form a "V"-shaped insertion opening between them prior to insertion of said bit when said binding is in the locked position.

7. The step-in binding as defined by claim 6 wherein said "V"-shaped insertion opening is formed by an incline on said support element and an inclined surface on said movable pressure element.

8. The step-in binding as defined by claim 1 further comprising a shoulder adapted to be mounted on said ski, said shoulder being adapted to provide a pivot point and to limit the movement of the base of said movable pressure element when said binding is in the locked position.

9. The step-in binding as defined by claim 8 wherein said shoulder is integral with and extends from said support element.

10. The step-in binding as defined by claim 8 wherein said movable pressure element comprises a lower transverse portion adapted to be held by said shoulder.

11. The step-in binding as defined by claim 10 wherein said shoulder comprises a vertical portion and a curved portion, said vertical portion and said curved portion providing a space sufficient to accommodate said lower transverse portion of said movable pressure element.

12. The step-in binding as defined by claim 1 wherein said elastic means comprises a compressible plug positioned within said slot.

13. The step-in binding as defined by claim 1 wherein said movable pressure element comprises an extension having a hole adapted to receive the tip of a ski pole whereby said ski pole is used to space said movable pressure element from said support element.

14. The step-in binding as defined by claim 1 in combination with said shoe or boot.

15. The step-in binding as defined by claim 1 wherein said support element comprises a zone adapted to contact the tip of said boot when said boot is secured to said binding.

16. The step-in binding as defined by claim 1 wherein said binding supports only the front of said boot on said ski.

17. The step-in binding as defined by claim 1 in combination with said boot, wherein said boot comprises two lateral sides and wherein the distance between said two lateral sides is greater than the width of said binding.

18. The step-in binding defined by claim 1 wherein said slot is oblong.

19. A method of using a binding which secures a ski shoe or boot onto a ski, wherein said boot comprises a latching element having a transverse bit across and in front of said shoe or boot, and said binding comprises a support element adapted to be mounted on a ski, a movable latch adapted to be secured to the ski, said latch comprising a movable pressure element, and wherein said binding further comprises means for biasing the movable pressure element toward the support element when the boot is unsecured to said binding, wherein said biasing means comprises:

a mounting comprising a transverse mounting bit extending through a slot in said movable pressure element;

pivot means adapted to be mounted on said ski, said movable pressure element being held by said mounting whereby said movable pressure element is pivotable around said pivot means; and elastic means adapted to resist pivotable movement of said movable pressure element away from said support element, wherein said method comprises the steps of:

(a) positioning said transverse bit of said boot above said support element and said movable pressure element wherein a portion of said movable pressure element contacts said support element;

(b) lowering said transverse bit between said portion of said movable pressure element and said support element, and introducing said support element between said transverse bit and said boot;

(c) moving said movable pressure element away from said support element as said transverse bit is lowered between said portion of said movable latch and said support element;

(d) lowering said transverse bit below said portion of said support element; and (e) moving said movable pressure element toward said support element so that said portion of said movable pressure element again contacts said support element.

20. A step-in binding for securing a ski shoe or boot onto a ski, wherein said boot comprises a latching element having a transverse bit across and in front of said shoe or boot, said binding comprising:

(a) a support element adapted to be mounted on a ski;

(b) a movable latch adapted to be secured to said ski, said latch comprising a movable pressure element;

(c) means for biasing said movable pressure element towards said support element when said boot is unsecured to said binding; and (d) an arch adapted to be mounted on said ski, said movable pressure element comprising a lower transverse portion extending through said arch, said arch having a vertical dimension greater than said lower transverse portion so as to allow for the vertical displacement of said lower transverse portion in said arch, whereby said shoe or boot may be secured by said binding to said ski by inserting said transverse bit between said support element and said pressure element when said movable pressure element is biased toward said support element and lowering said transverse bit between said movable pressure element and said support element.

21. The step-in binding defined by claim 20 wherein said movable pressure element is journalled on a mounting, said movable pressure element comprising elastic means adapted to permit the translational movement of said movable pressure element relative to said mounting when said transverse bit is inserted in said arch.

* * * * *